US006398213B1

(12) United States Patent
Würschum et al.

(10) Patent No.: US 6,398,213 B1
(45) Date of Patent: Jun. 4, 2002

(54) DEVICE FOR ENABLING ACCESS TO THE INTERIOR OF AN APPARATUS

(76) Inventors: Hans-Peter Würschum, Heidelberg Digital Finishing GmbH, 73347 Mühlhausen; Anton Oswald, 73734 Esslingen, both of (DE)

( * ) Notice: Subject to any disclaimer, the term of this patent is extended or adjusted under 35 U.S.C. 154(b) by 0 days.

(21) Appl. No.: 09/479,676

(22) Filed: Jan. 7, 2000

(30) Foreign Application Priority Data

Apr. 23, 1999 (DE) ..... 199 18 540

(51) Int. Cl.[7] ..... B65H 31/04

(52) U.S. Cl. ..... 271/213; 271/162; 271/207; 271/314

(58) Field of Search ..... 271/162, 207, 271/213, 314

(56) References Cited

U.S. PATENT DOCUMENTS 4,735,408 A * 4/1988 Yamashita et al. ..... 271/207
4,965,640 A * 10/1990 Watarai et al.
6,003,865 A * 12/1999 Hayashi et al. ..... 271/213

* cited by examiner

*Primary Examiner*—H. Grant Skaggs
(74) *Attorney, Agent, or Firm*—Lawrence P. Kessler

(57) ABSTRACT

A device for enabling access to an interior of an apparatus, with means for unlocking and swinging an upper apparatus housing part supporting a sheet stacking container clear out of a sheet dispensing area of the apparatus that has a sheet discharge unit and is freely accessible for sheet removal. To provide a device which permits simple access from above into the apparatus during servicing work, has a simple, compact and inexpensive design, and ensures reliable operation in both sheet conveying and in sheet discharge/stacking, the means for unlocking and swinging the upper apparatus housing part clear have means for displacement of the sheet stacking container out of an overlapping end area of the sheet discharge unit into a position outside the apparatus and at a distance to this end area, with the position of the sheet stacking container outside the apparatus being predetermined such that the sheet stacking container can be moved past the sheet discharge unit during the joint swivel movement with the upper apparatus housing part without interference with the sheet discharge unit.

10 Claims, 5 Drawing Sheets

DEVICE FOR ENABLING ACCESS TO THE INTERIOR OF AN APPARATUS

FIELD OF THE INVENTION

The invention relates to a device for enabling access to an interior of an apparatus that has a sheet discharge unit, with a mechanism for unlocking an upper apparatus housing part, supporting a sheet stacking container, and enabling such upper apparatus housing part to swing clear out of a sheet dispensing area of the apparatus so that such sheet discharge unit is freely accessible for sheet removal.

BACKGROUND OF THE INVENTION

A device of the type for an upper apparatus housing part carrying a sheet stacking container for unlocking and enabling swinging such upper apparatus housing part clear is generally known from EP-0 333 106-B1. The sheet discharge unit, which has a C-shaped sheet guide track and a sheet discharge roller pair arranged on its upper sheet discharge end in the insertion area of the sheet stacking container, is, together with the sheet stacking container having a sheet stacking surface downward-inclined against the sheet discharge direction, an integral part of the upper apparatus housing part and rigidly connected thereto. The upper apparatus housing part is pivotably mounted by means of a rotational axis in the rear area of the C-shaped sheet guide track or of the apparatus at the stationary lower apparatus housing part. A front area of the apparatus opposite the rear area on the upper apparatus housing part has a handle part and locking means acting on the lower housing part by means of which the upper apparatus housing part is manually unlockable and swivelable along the sheet conveyor track and upwards about the rotational axis into an open position such that access to the apparatus interior is possible.

The disadvantage of this disclosed embodiment is that the C-shaped sheet guide track must have a point of separation, i.e. between a track area swivelable with the upper housing part and a stationarily attached track area in the lower housing part. Without an additional sheet conveying roller pair and without complex design of the sheet guide track at the point of separation, the result is unreliable sheet conveying in the sheet guide track and hence unreliable sheet discharge and stacking in the sheet stacking container.

SUMMARY OF THE INVENTION

The object underlying the present invention is therefore to provide a device that does not have these disadvantages, but instead permits simple access from above into the apparatus during servicing work, has a simple, compact and inexpensive design, and ensures reliable operation in both sheet conveying and in sheet discharge/stacking.

This object is attained with a device according to claim 1 and in accordance with the invention in that the mechanism for unlocking of the upper apparatus housing part and enabling such part to swing clear of the apparatus have a mechanism for displacement of the sheet stacking container out of an overlapping end area of the sheet discharge unit into a position at a distance from this end area, with the position of the sheet stacking container being predetermined such that the sheet stacking container can be moved past the sheet discharge unit during swivel movement with the upper apparatus housing part without touching (interference) of the sheet discharge unit and the upper apparatus housing part.

The sheet stacking container is advantageously movable by a displacement device along a sheet conveyor track that is substantially horizontal in its end area or along the sheet conveying direction of the sheet discharge unit on the upper apparatus housing part, from an initial position in the overlapping end area of the sheet discharge unit to a position outside the apparatus and back again.

Furthermore, the unlocking and swiveling mechanisms are advantageously arranged with the mechanism displacement on the upper apparatus housing part and have a handle that can be swiveled for their actuation. As such, first the displacement mechanism of the sheet stacking container and then the unlocking mechanism are movable in the event of manual actuation for the swinging clear and opening of the upper apparatus housing part by actuating elements arranged thereon.

BRIEF DESCRIPTION OF THE DRAWINGS

In the detailed description of the preferred embodiments of the invention presented below, reference is made to the accompanying drawings in which.

DETAILED DESCRIPTION OF THE INVENTION

Figure 1:
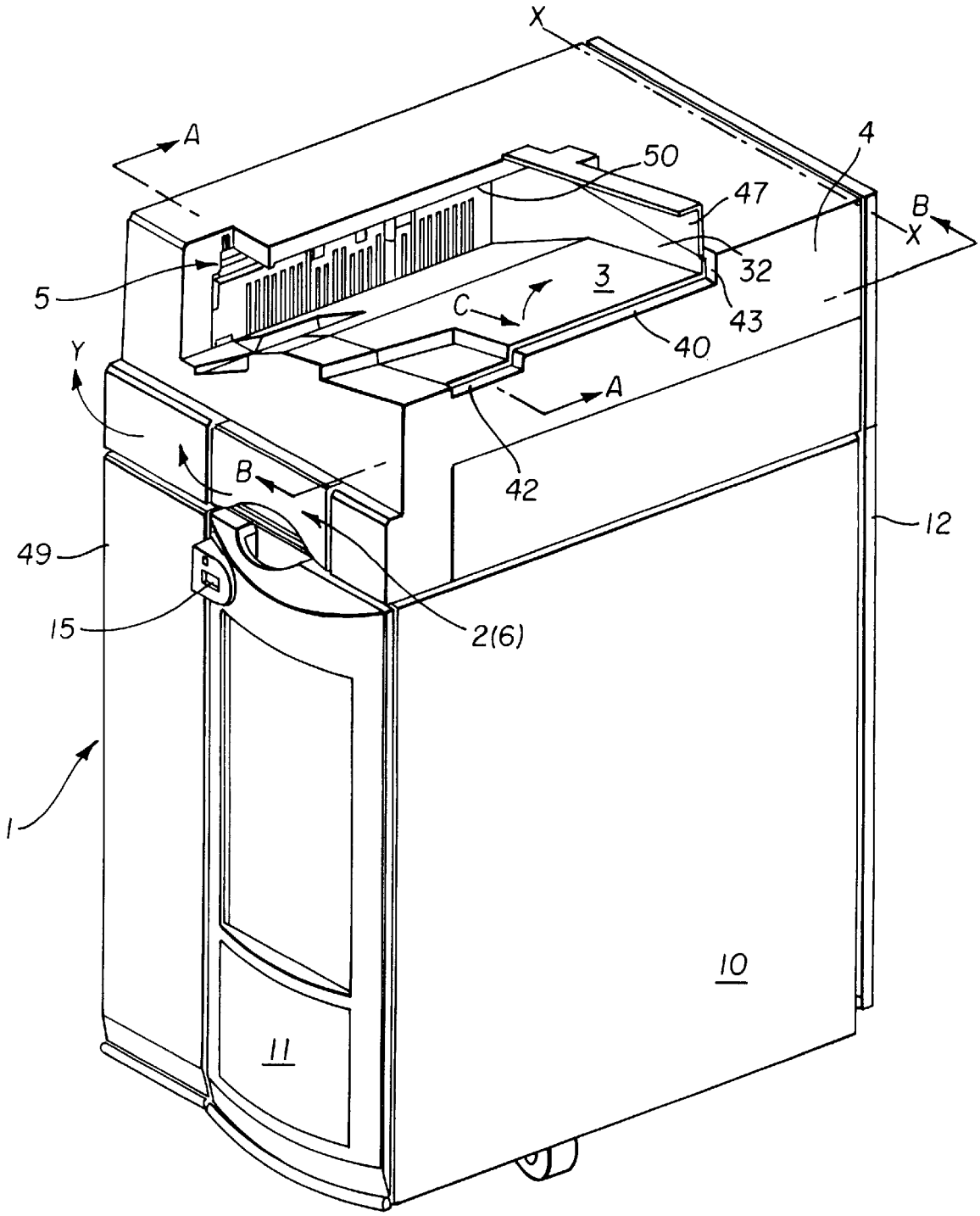
FIG. 1 shows the device in accordance with the invention in an apparatus for sheet discharge in a three-dimensional representation.

The following description according to FIGS. 1 to 5 relates to a preferred embodiment of the device in accordance with the invention for enabling access to the interior of an apparatus 1. The apparatus 1 has an upper apparatus housing part 4 carrying a sheet stacking container 3 and having a sheet discharge unit 5. A mechanism 2 is provided for unlocking and swinging clear of the upper apparatus housing part 4 out of a sheet dispensing area of the apparatus 1, which area is then freely accessible for sheet removal.

The device is here used in an apparatus of known type, such as for example in a sheet discharge apparatus unit of a copier, not shown, and serves preferably for the discharge of customer-specific paper sheets carrying a toner image.

For a person skilled in the art in this particular field, it is self-evident that the inventive device can also be used in other apparati, such as printers or sheet sorting equipment. Moreover, the sheet stacking container can also have, besides the design form shown and described with an inclined stacking surface and freely accessible sheet dispensing area, a non-inclined and horizontal stacking surface that is not freely accessible. Furthermore, as described in the following, the sheet discharge unit can have instead of a sheet discharge roller pair an endless conveyor belt; and the action whereby the upper apparatus housing part swings clear of the apparatus can also be effected longitudinally to the sheet conveying direction instead of transversely to it.

The apparatus 1 according to FIG. 1 shows a lower apparatus housing part 10 with a housing side panel 49 accessible to an apparatus operator. A housing door 11 and an apparatus ON/OFF switch 15 are arranged on the accessible housing side panel. A housing side panel 12, reaching approximately to the top edge of the upper apparatus housing part 4 is located opposite housing side panel 49. The lower housing part 10 is in the form of an approximately rectangular container open to the top. The upper housing part 4 is in the form of a container open at the bottom, and rests on the housing part 10 as its closing cover.

The sheet stacking container 3 is arranged so as to rest on a support surface 40 in a recess at a comer of the upper housing part 4. The lower-placed comer of the support housing part 4 is formed by the housing side panel facing the operator and a rear housing panel positioned downstream in the sheet conveying direction C. An upstream front housing panel 49 of the lower housing part 10 is connected to a copier, not illustrated, and has a passage opening (not shown in the area of the upper housing part 4). A part-section of a sheet conveyor track 52 of the sheet discharge unit 5 projects into such passage opening such that paper and/or film sheets S, having a toner image, coming from the copier are conveyable by the sheet discharge unit into the sheet stacking container 3 and are freely accessible from above (see FIGS. 1 and 2).

The sheet stacking container 3 has a sheet stacking surface 30 inclined downwards relative to the sheet discharge direction C and ending at a front panel 31 of the container. The front panel 31, acting as a sheet stop, is aligned at right angles and vertical to the sheet conveyor track 52. The inclination angle of the sheet stacking surface 30 in the front area close to the panel 31 is greater than in the area away from the panel so that the sheets conveyed into the sheet stacking container slide downwards and against the front panel and align thereon flush with the sheet conveyor track.

Figure 2:
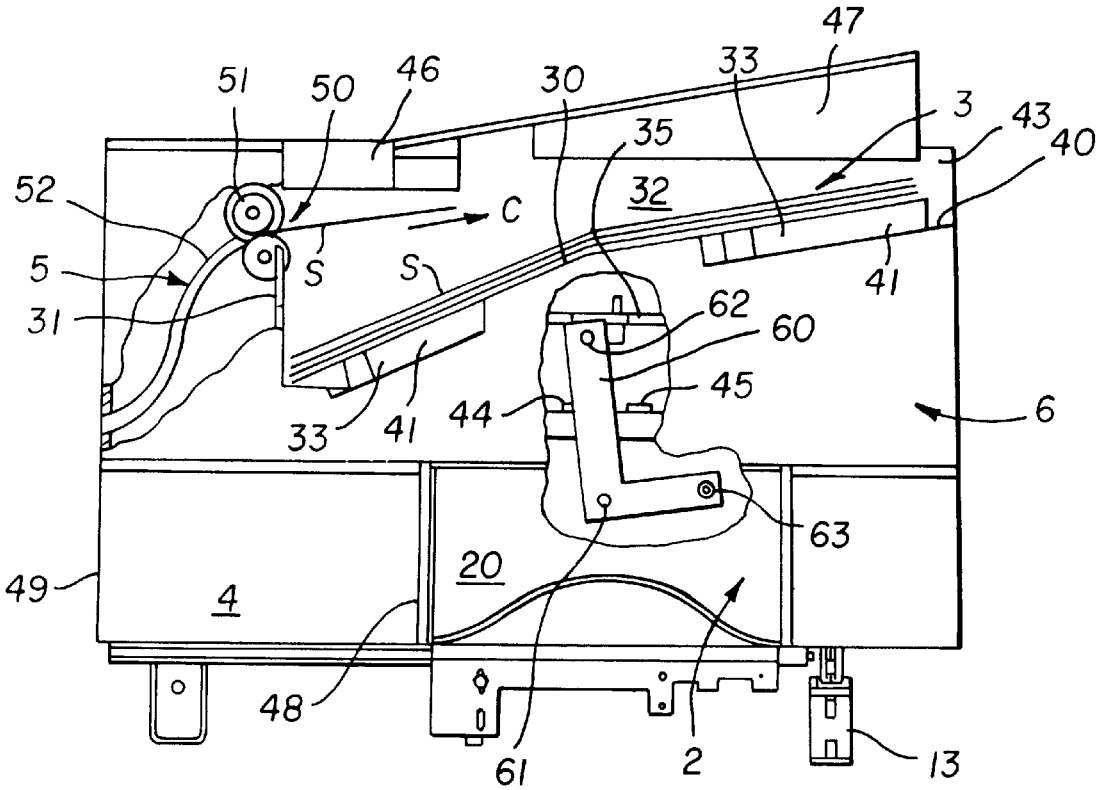
FIG. 2 shows the device in accordance with the invention from FIG. 1 in a partly cut-out side view along a section "A—A", where the device is shown in a sheet discharge position with a sheet stacking container and its displacement and swiveling mechanism in an initial position inside the apparatus.
Figure 3:
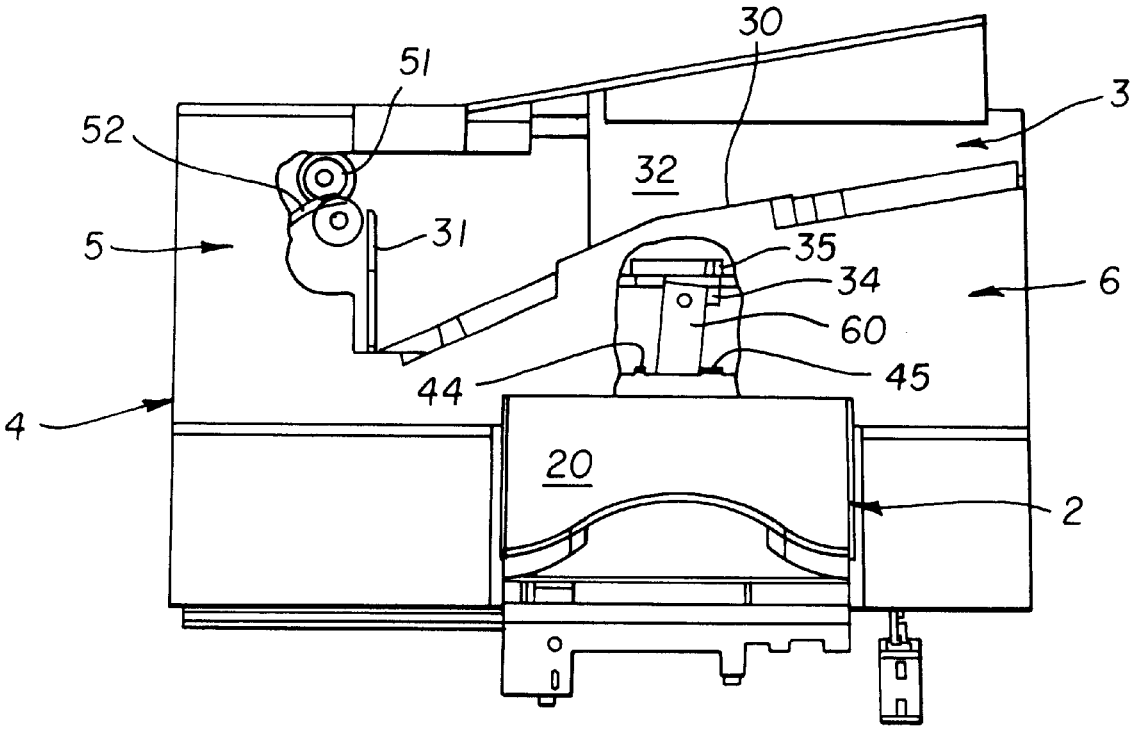
FIG. 3 shows the device in accordance with the invention from FIG. 2, where the sheet stacking container and its displacement and swiveling mechanism are shown in an end position outside the apparatus, from which the sheet stacking container can be swiveled together with an upper apparatus housing part.
Figure 4:
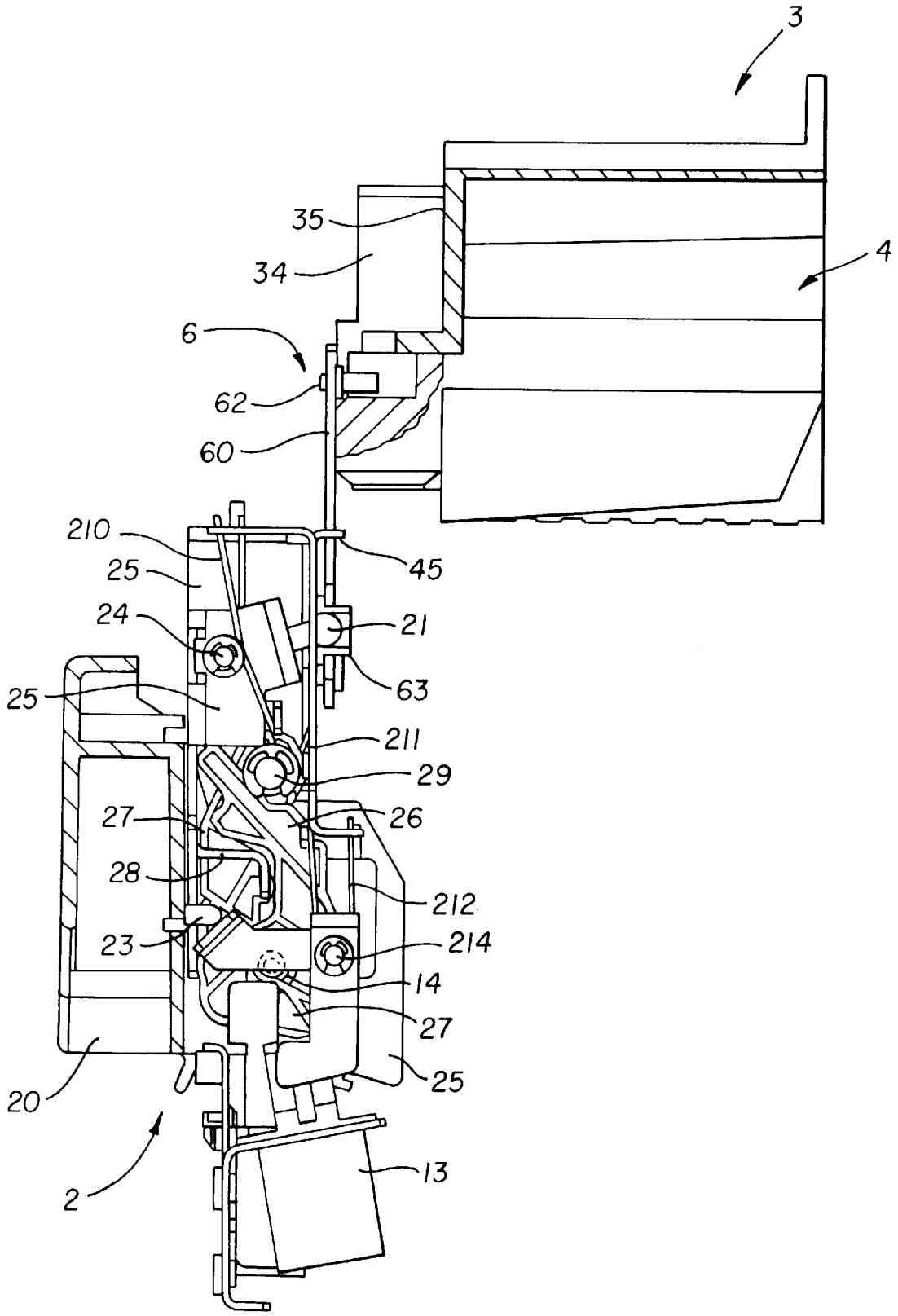
FIG. 4 shows the device in accordance with the invention from FIGS. 1 and 2 in a front view along a section "B—B" with the mechanism for displacement, swinging clear and unlocking in the initial position inside the apparatus.

As shown in FIGS. 1 to 3, the support surface 40 for the sheet stacking container 3, on the upper housing part 4, has substantially the same inclination angle as the sheet stacking surface 30 of the sheet stacking container 3. As such, sheet stacking container 3 also tends to slide downwards against the sheet conveying direction C into an initial position or starting position in the sheet dispensing area of the sheet discharge unit 5.

Lateral guides 42,43 are arranged on the upper apparatus housing part 4. The sheet stacking container 3 is guided between the lateral guides in the known manner and held in a positive connection during displacement and swiveling of the upper housing part 4. The lateral guide 42 located on the operating side of the apparatus is an integral part of the housing side panel in the lower-placed corner of the upper housing part, with this housing side panel having a height equal to the height position of the sheet stacking surface 30 of the sheet stacking container 3. The second lateral guide 43 is arranged parallel opposite the first at a limiting panel of the recessed area for the sheet stacking container 3, and is also formed by a side panel 32 of the sheet stacking container adjacent to the lateral guide 43 and a lateral upper sheet guide 47 attached to the limiting panel.

For easier removal of one or more sheets S conveyed into the sheet stacking container 3, two removal recesses 33 are provided on the side panel of the upper apparatus housing 4 facing the operating side and extend at right angles transversely to the sheet conveying direction C into the sheet stacking surface 30 of the sheet stacking container 3. One of the recesses 33 is in the area of the front stop panel 31 of the stacking container 3, and the other is in the corner area outside the apparatus at the rear housing panel of the apparatus 1. In the support surface 40 for the sheet stacking container 3, suitable cutouts 41 are provided that are longer along the sheet conveying direction C in order to provide latitude for movement for the sheet stacking container.

The mechanism 2 for unlocking the upper apparatus housing part 4 and enabling it to swing clear have, as shown in FIGS. 2 to 5, a mechanism 6 for displacement of the sheet stacking container 3, out of an overlapping end area 50 of the sheet discharge unit 5, into a position outside the apparatus and at a distance to this end area. The position of the sheet stacking container outside the apparatus is predetermined such that the sheet stacking container can be moved past the sheet discharge unit during the joint swivel movement with the upper apparatus housing part without touching (interference).

The sheet stacking container 3 can be displaced in a substantially horizontal direction to the end area of the sheet discharge unit 5 by the displacement mechanism 6 along the sheet conveyor track 52 of the sheet discharge unit. Alternatively displacement by the mechanism 6 may be along the sheet conveying direction on the support surface 40 of the upper apparatus housing part 4, from its initial position in the overlapping end area 50 of the sheet discharge unit 5 to its position outside the apparatus and back again.

The sheet discharge unit 5 has, in its sheet conveyor track, an end area 50 overlapping the intake area of the sheet stacking container 3. Positioned above this sheet stacking container 3 is a sheet discharge roller pair 51 stationarily arranged in the lower part 10 of the apparatus 1. The roller pair 51, arranged at the sheet conveyor track end area 50, projects (as shown in FIGS. 1 and 2) through penetrations in the front panel 31 into the insertion area of the sheet stacking container in the initial position or starting position of the sheet stacking container 3. Since the front panel 31 of the sheet stacking container 3 ends with its upper edge below the sheet discharge gap of the roller pair 51, only the lower roller of the roller pair projects through the penetrations adapted to the lower roller and provided in the upper area of the front panel 31. The upper and lower rollers of the roller pair 51 are drivable by a microprocessor-controlled drive unit of the apparatus for sheet discharge out of the apparatus or for sheet feed into the sheet stacking container 3. Each roller pair has on its roller axes several narrow plastic rollers arranged adjacently and at a distance from one another in the axial direction, so that the penetrations in the front container panel 31 are designed in the form of slots.

The mechanism 2 for unlocking and enabling swinging is shown in FIGS. 1 to 5 as arranged with the displacement mechanism 6 on the upper apparatus housing part 4. Such mechanisms 2 and 6 have a swivelable handle 20 for actuation. By operator actuation through the handle 20, the displacement mechanism 6 of the sheet stacking container 3 and then the unlocking mechanism 2 are movable for the swinging clear and opening of the upper apparatus housing part 4 by actuating elements 21,22,23 arranged on such handle. The handle 20 is located on the operator side of the apparatus in an adapted cutout 48 in the central area of the side panel of the upper housing part 4. A swivel bearing, or axis 24, for the handle 20 is provided on a cantilever element 25, which is rigidly connected to the housing part 4. Accordingly, the handle 20 can swivel in the same direction as the housing part 4 about the axis 24.

An electrical apparatus safety switch 13, in association with the handle 20, is provided for switching off the apparatus 1 before unlocking and/or swinging clear of the upper housing part 4. The safety switch 13 is actuatable by the actuating elements 21,22,23 of the handle 20 when the latter is actuated for unlocking of the upper apparatus housing part 4.

The upper apparatus housing part 4 is swivelable jointly with the sheet stacking container 3, about a swivel axis X—X stationarily arranged on a lower apparatus housing part 10 by actuation of the handle 20, transversely or at right angles to the sheet conveying direction and conveyor track of the sheet discharge unit 5. The swivel axis X—X is mounted in the area of the rear side panel 12 of the lower apparatus part 10. The upper housing part 4 is movable from a horizontal closed-apparatus position into a vertical open-apparatus position, where a swivel angle of equal to or greater than 100 degrees is provided for reaching a stable open-apparatus stationary position of the upper housing part 4.

The actuating elements 21,22,23 of the handle 20 include a first 21, a second 22 and a third actuator 23. The first actuator 21 is in effective connection with a swivelable, spring-loaded L-shaped lever 60 of the displacement mechanism 6. The second actuator 22 is in effective connection with a swivelable, spring-loaded engaging catch 27 of the locking mechanism 2. The third actuator 23 is in effective connection with an actuating lever 213 of the apparatus safety switch 13.

As shown in FIGS. 2 to 5, the first actuator 21 is provided at the upper end area of the handle 20 in the direction of the apparatus interior and also serves as a bearing part mounted on the swivel axis 24 for the handle 20. The first actuator 21 engages, with its spherical end facing the interior of the apparatus, in a socket 63 located on a short leg end of the L-shaped lever 60. As such, the lever 60, mounted in the intersection of its legs on a swivel bearing 61, is also swivelable during swiveling of the handle 20 in a direction along the sheet conveying direction or along the movement direction of the sheet stacking container 3. The swivel direction of the L-shaped lever 60 of the displacement mechanism 6 is also at right angles or transverse to the swivel direction of the handle 20. The L-shaped swivel lever 60 is mounted in a plane-parallel position, relative to the housing side panel facing the operator's side, on the swivel bearing 61 in turn mounted on the cantilever element 25.

An actuating pin 62 is arranged on the long leg end of the L-shaped lever 60 and engages in a sleeve 34 provided on a lower area of a side panel 35 of the sheet stacking container 3. As such during swiveling of the L-shaped lever 60 by the handle the sheet stacking container 3 is movable along the sheet conveying direction.

A front end stop 44 and a rear end stop 45 are provided on the upper housing part 4 for limiting the displacement movement of the sheet stacking container 3. The two end stops are attached to the cantilever 25 and limit the swiveling range of the L-shaped lever 60 of the displacement mechanism 6. The handle 20 can be moved into and held in a starting position contacting the housing part 4 by the spring force of a first leg spring 210 mounted on the swivel bearing 24 and engaging with its leg ends on the one hand in the bearing area 24 on the handle and on the other hand on the stationary cantilever 25. Further, by such spring force, the L-shaped swivel lever 60 with the sheet stacking container 3 can be moved into its initial position at the front end stop 44 when the upper apparatus housing part 4 is in the closing position.

Figure 5:
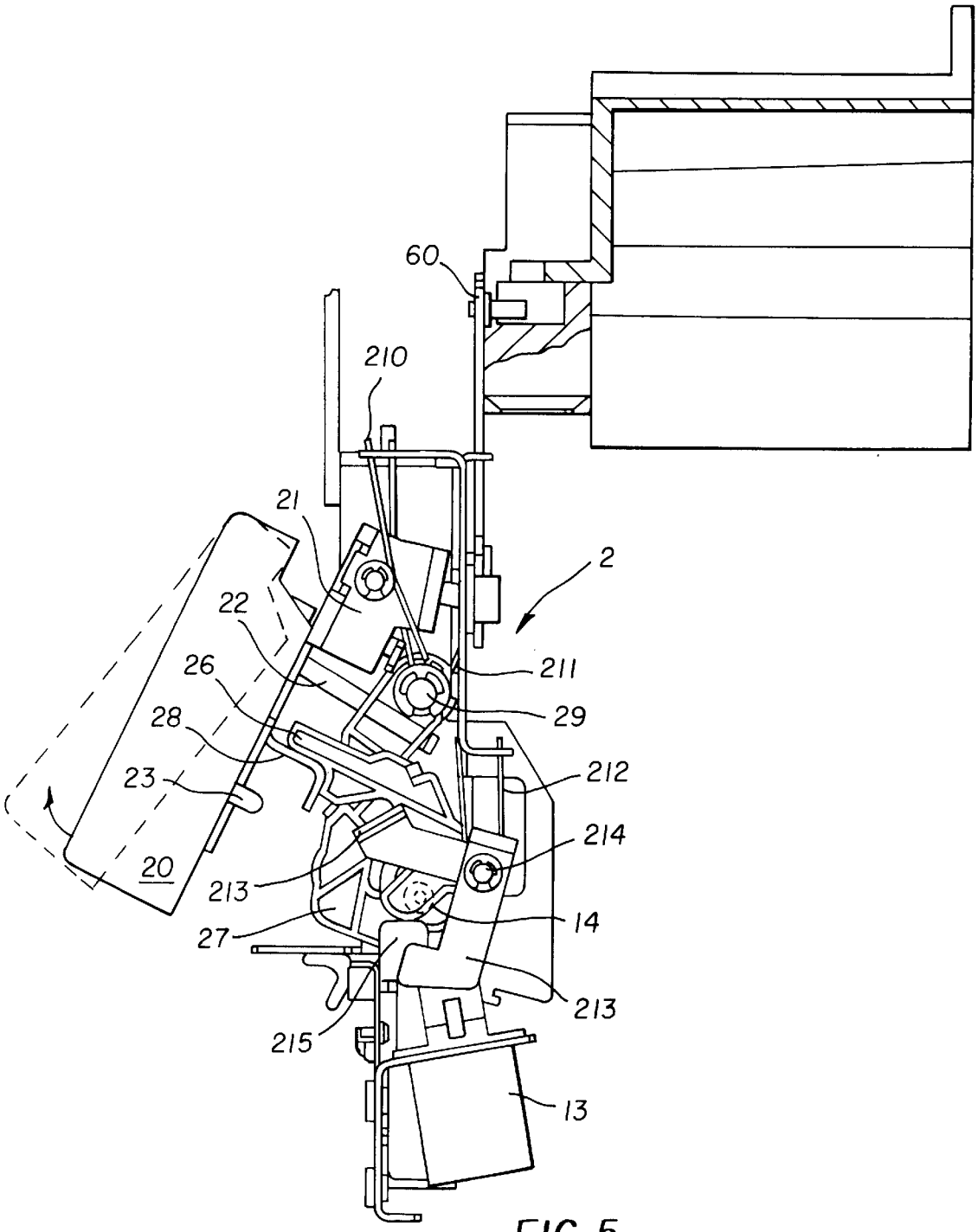
FIG. 5 shows the device in accordance with the invention from FIGS. 1 and 3 in a front view along the section "B—B" with the mechanism for displacement, swinging clear and unlocking in the end position outside the apparatus.

The handle 20 can also be locked by its engaging lever 28 and a swivelable, spring-loaded cam lever 26 when the upper housing part 4 is closed. Further, the handle can be locked in a position contacting the housing part 4, and in a position swiveled away from the housing part at an angle of approx. 30 degrees when the housing part is unlocked and closed or opened. The spring force is generated by a further leg spring 212 mounted on a swivel bearing 214 of the cam lever 26 and with its leg ends engaging with the cam lever and with the retaining angle. The cam lever 26 is swivelable counterclockwise by this second leg spring 212 during swiveling of the handle 20 into a position about 60 degrees outside the apparatus relative to the side panel of the upper apparatus housing part 4. In such position, the engaging lever 28 of the handle 20 can rest on an engaging cam of the cam lever 26, as shown in FIG. 5, and the handle is secured against a swiveling-back movement effected by the first leg spring 210.

For releasing of this swivel-back prevention of the handle 20 to swivel it back into its starting position contacting the upper apparatus housing part 4, a release lever 215 is stationarily arranged underneath the handle on the lower housing part 10. The release lever presses, during swinging down of the upper housing part 4 into its closing position, from downwards against a cam disc arranged at the lower end of the cam lever 26 around the swivel bearing 214. Accordingly, the cam lever 26 is swiveled with its engaging cam clockwise and upwards and out of the area of the engaging lever.

The engaging catch 27 of the unlocking mechanism 2 is mounted on a further swivel bearing 29. When the upper housing part 4 is swiveling down into its closing position, the engaging catch 27 is movable by the spring force of a third leg spring 211, arranged on this swivel bearing 29, into a lower engaging position in which the engaging catch 27 (with its downward hanging engaging hook) partially encloses an engaging pin 14 rigidly arranged on the lower apparatus housing part 10 (see FIG. 4).

For releasing the lock for the purpose of opening or swiveling up of the upper housing part 4, the engaging catch 27 is, during swiveling of the handle 20 up into the position furthest outside the apparatus (shown in FIG. 5 as a dashed line), swivelable by the second actuating element 22 of the handle. The actuator element 22 includes a hook (shown in FIG. 5), urged against the spring force of the third leg spring 211 about the swivel bearing 29 and movable out of engagement with the engaging pin 14.

For actuation of the apparatus safety switch 13, the unlocking mechanism 2 has an L-shaped actuating lever 213, mounted on the swivel bearing 214 of the cam lever 26. When the handle 20 is swiveled out/up, the actuating lever 213 is movable by the spring force of the leg spring 212 into an upper position in which the safety switch 13 has switched off the apparatus 1 (see FIG. 5). When swiveling down the handle 20, the actuating lever 213 is actuatable by contact of the actuator element 23 with a ramp-like switching surface provided at the first end of the actuating lever 213. As such, the safety switch 13 can be switched on by the second end of the actuating lever 213 by its downward movement, with the safety switch 13 being switched on shortly before the position of the handle 20 is reached in contact with the apparatus housing part 4 (see FIG. 4).

The invention has been described in detail with particular reference to preferred embodiments, thereof, but it will be understood that variations and modifications can be effected within the ordinary skill in the art without departing from the spirit and scope of the invention.

PARTS LIST

C Sheet conveying direction/sheet discharge direction
S Sheet (paper, film etc.)
X Swivel axis on lower housing part for upper housing part of apparatus
Y Swivel direction of the upper apparatus housing part
1. Apparatus
2. Mechanism for unlocking/locking and swinging clear of the upper housing part
3. Sheet stacking container
4. Upper apparatus housing part
5. Sheet discharge unit
6. Mechanism for displacement of the sheet stacking container
10. Lower apparatus housing part
11. Housing door
12. Rear side panel of lower housing part
13. Apparatus safety switch
14. Engaging pin for engaging catch (unlocking/locking mechanism)
15. Apparatus ON/OFF switch
20. Handle (mechanism for unlocking/locking and swiveling clear)
21. First actuating mechanism/actuator (displacement mechanism)
22. Second actuating mechanism/actuator (unlocking/locking mechanism)
23. Third actuating mechanism/actuator (apparatus safety switch)
24. Swivel bearing for handle
25. Cantilever for swivel bearing
26. Cam lever for handle
27. Engaging catch of unlocking/locking mechanism
28. Engaging lever for cam lever (handle)
29. Swivel bearing for engaging catch
30. Sheet stacking surface of the sheet stacking container
31. Front panel/sheet stop of the sheet stacking container
32. Side panel of the sheet stacking container
33. Sheet/sheet stack removal recess
34. Sleeve for actuating pin of the displacement lever
35. Side panel for mounting of sleeve
40. Support surface for sheet stacking container on upper housing part
41. Cutout on support surface (for removal recess of stacking container)
42. First/left-hand lateral guide for stacking container
43. Second/right-hand lateral guide for stacking container
44. Front end stop for displacement lever
45. Rear end stop for displacement lever
46. Front/upper sheet guide (discharge area of sheet discharge unit)
47. Lateral/upper sheet guide (in area of the sheet stacking container)
48. Cutout for handle on upper apparatus housing part
49. Front housing panel of the apparatus
50. Overlapping end area of sheet discharge unit
51. Sheet discharge roller pair
52. Sheet conveyor track
60. Swivelable L-shaped lever of displacement mechanism
61. Swivel bearing for lever
62. Actuating pin on lever
63. Bearing socket for spherical actuator end of displacement mechanism (handle)
210. Leg spring on actuator of handle
211. Leg spring on engaging catch
212. Leg spring on cam lever & actuating lever for safety switch
213. Actuating lever for apparatus safety switch
214. Swivel bearing for actuating lever & cam lever
215. Release lever for cam lever

What is claimed is:

1. A device for enabling access to an interior of an apparatus including an upper apparatus housing part supporting a sheet stacking container and a sheet discharge unit for dispensing sheets into a sheet dispensing area overlapping said sheet stacking container, freely accessible for sheet removal, said device comprising:

mechanism for unlocking and swinging said upper apparatus housing part and said sheet stacking container out of said sheet dispensing area clear of said sheet discharge unit; wherein said means for unlocking and swinging said upper apparatus housing part and said sheet stacking container includes a mechanism for displacement of said sheet stacking container out of said overlapping dispensing area of said sheet discharge unit into a position at a distance from said overlapping dispensing area, the position of said sheet stacking container being predetermined such that said sheet stacking container can be moved past said sheet discharge unit during swinging movement of said sheet stacking container with said upper apparatus housing part without interference with said sheet discharge unit.

2. Device according to claim 1, wherein said sheet stacking container is movable by said displacement mechanism along a substantially horizontal sheet conveyor track of said sheet discharge unit in its sheet dispensing area on said upper apparatus housing part from an initial position in the overlapping sheet dispensing area of said sheet discharge unit to a position outside said apparatus and back again.

3. Device according to claim 2, wherein said upper apparatus housing part includes lateral guides, said sheet stacking container being guided and held in a positive connection during displacement and swiveling of said upper apparatus housing part by said lateral guides.

4. Device according to claim 1, wherein said means for unlocking and swinging are arranged with said displacement mechanism on said upper housing part, said upper housing part including a handle that can be swiveled for actuation by which first said displacement mechanism and then said unlocking means are movable in the event of manual actuation for the swinging clear and opening of said upper apparatus housing part by actuating elements arranged on said handle.

5. Device according to claim 4, wherein said upper apparatus housing part is swivelable jointly with said sheet stacking container, at right angles to the sheet conveying direction and sheet conveyor track by said handle, at right angles to the sheet conveying direction and sheet conveyor track of the sheet discharge unit from a horizontal closed-apparatus position into a vertical open-apparatus position about a swivel axis arranged on said apparatus, where a swivel angle greater than 100 degrees is provided for reaching a stable open-apparatus position of said upper housing part.

6. Device according to claim 5, wherein said handle includes actuating means having a first actuator element and a second actuator element, where said first actuator element is in effective connection with a swivelable, spring-loaded L-shaped lever of said displacement mechanism, and said second actuator element is in effective connection with a-swivelable, spring-loaded engaging catch of said unlocking means.

7. Device according to claim 6, wherein said handle includes a swivelable, spring-loaded cam lever, and wherein said handle can be locked by said swivelable, spring-loaded cam lever when said upper housing part is closed and locked, and swiveled away when said upper housing part is unlocked and closed or opened.

8. Device according to claim 4, wherein said handle includes an electrical safety switch for switching off said apparatus, said electrical safety switch being actuatable by means associated with said handle when said handle is actuated for unlocking said upper apparatus housing part.

9. Device according to claim 1, wherein said sheet discharge unit has, adjacent to said sheet dispensing area, a sheet discharge roller pair stationarily arranged in said apparatus.

10. Device according to claim 9 wherein said sheet stacking container includes a front panel providing a sheet stop, and a sheet stacking surface aligned at right angles and vertical to the sheet conveyor track inclined downwards against the sheet discharge direction and ending at said front panel, and in said roller pair projects through penetrations in said front panel.

* * * * *